US012234626B2

(12) United States Patent
Behmlander et al.

(10) Patent No.: US 12,234,626 B2
(45) Date of Patent: Feb. 25, 2025

(54) MAINTENANCE-SERVICE SYSTEM

(71) Applicant: Caterpillar SARL, Geneva (CH)

(72) Inventors: Matthew Jacob Behmlander, West Olive, MI (US); Jacob Charles Maley, Germantown Hills, IL (US)

(73) Assignee: Caterpillar SARL, Geneva (CH)

( * ) Notice: Subject to any disclaimer, the term of this patent is extended or adjusted under 35 U.S.C. 154(b) by 437 days.

(21) Appl. No.: 17/689,441

(22) Filed: Mar. 8, 2022

(65) Prior Publication Data

US 2023/0287655 A1 Sep. 14, 2023

(51) Int. Cl.
*E02F 9/22* (2006.01)
*E02F 9/26* (2006.01)

(52) U.S. Cl.
CPC ..... *E02F 9/226* (2013.01); *E02F 9/2253* (2013.01); *E02F 9/262* (2013.01)

(58) Field of Classification Search
CPC ..... E02F 9/226; E02F 9/2253; E02F 9/262; E02F 9/2033; E02F 9/2246; E02F 9/24; E02F 9/267
See application file for complete search history.

(56) References Cited

U.S. PATENT DOCUMENTS 8,712,671 B2 4/2014 Adachi et al.
9,067,586 B2 6/2015 Kawashima et al.
9,139,983 B2 9/2015 Yoshida et al.
9,458,842 B2 10/2016 Berg
10,350,994 B2 7/2019 Didierjean et al.
2003/0167660 A1* 9/2003 Kondou ..... E02F 9/02 37/348
2010/0064677 A1* 3/2010 Kawaguchi ..... E02F 9/2075 318/446
2011/0202261 A1* 8/2011 Adachi ..... F02D 41/12 701/104
2015/0039187 A1* 2/2015 Friebel ..... F02N 11/0814 701/50
2016/0194854 A1 7/2016 Yamazaki et al.
2018/0171593 A1 6/2018 Behmlander et al.
(Continued)

FOREIGN PATENT DOCUMENTS

EP 2754757 7/2014
EP 3739419 11/2020
(Continued)

OTHER PUBLICATIONS

Written Opinion and International Search Report for Int'l. Patent Appln. No. PCT/EP2023/025095, mailed Jun. 7, 2023 (88 pgs).

*Primary Examiner* — Karen Beck

(57) ABSTRACT

A maintenance-service system and method for controlling a machine that includes a plurality of operational modes is disclosed. The plurality of operational modes including a normal mode and a hazard detected mode. The maintenance-service system may comprise a controller configured to receive authorization data when machine is in the hazard detected mode, and enable movement of the machine at a reduced machine speed based on the authorization data, wherein the reduced machine speed is less than 50% of a normal machine speed available to the machine when the operational mode is the normal mode, wherein, the hazard detected mode precludes movement of the machine.

20 Claims, 3 Drawing Sheets

(56) References Cited

U.S. PATENT DOCUMENTS

| | | | | |
|---|---|---|---|---|
| 2019/0170879 | A1 | 6/2019 | Kinoshita et al. | |
| 2021/0332558 | A1* | 10/2021 | Lensing | E02F 9/2235 |
| 2022/0178111 | A1* | 6/2022 | Nanbu | E02F 9/2066 |
| 2022/0251809 | A1* | 8/2022 | Sanerma | E02F 9/205 |
| 2022/0389684 | A1* | 12/2022 | Okabe | E02F 9/2025 |
| 2023/0104700 | A1* | 4/2023 | Danguchi | E02F 9/2285<br>701/50 |

FOREIGN PATENT DOCUMENTS

| | | | | |
|---|---|---|---|---|
| WO | WO-2020123413 | A1 * | 6/2020 | B25J 11/00 |
| WO | WO-2024135228 | A1 * | 6/2024 | |

* cited by examiner

MAINTENANCE-SERVICE SYSTEM

TECHNICAL FIELD

The present disclosure generally relates to maintenance and service systems, and more particularly, maintenance and service systems for heavy equipment.

BACKGROUND

Machines, especially heavy equipment, with control systems that include personnel or object detection sensors may present challenges to service or troubleshoot. The control system may prevents movement of the machine during planned service or troubleshooting because sensors detect a person, object, wall or another machine in close proximity to the machine and trigger disablement of the machine. This may happen in a service shop or in the field. It may also occur when the control system is being calibrated/commissioned. When this happens, the machine is not able to be moved or operated.

U.S. Pat. No. 9,139,983 issued Sep. 22, 2015, discloses an engine electronically controlled by a control device, a hydraulic motor for traveling which is driven by a pressurized oil delivered from a hydraulic pump, and a traveling speed switching member which switches a traveling speed by the hydraulic motor at least in two stages of a low speed and a high speed. The control device includes an output lowering determination unit for determining whether or not a fuel injection amount to be supplied to the engine is limited and an engine output is in a lowered state and a low-speed control unit in which, when the engine output is in a lowered state, a traveling speed is controlled to a low speed state kept lower than a high speed even if the traveling speed switching member has been switched to the high speed side. A better system is desired.

SUMMARY OF THE DISCLOSURE

In one aspect of the present disclosure, a maintenance-service system for a machine that includes a plurality of operational modes is disclosed. The plurality of operational modes including a normal mode and a hazard detected mode. The maintenance-service system may comprise a controller configured to: receive authorization data when machine is in the hazard detected mode; and enable movement of the machine at a reduced machine speed based on the authorization data, wherein the reduced machine speed is less than 50% of a normal machine speed available to the machine when the operational mode is the normal mode, wherein, the hazard detected mode precludes movement of the machine.

In another aspect of the disclosure, a method of controlling a machine having a plurality of operational modes is disclosed. The plurality of operational modes may include a normal mode, a hazard detected mode and an off mode. The method may comprise: after activation of the hazard detected mode, receiving, by a controller, authorization data; and enabling, by the controller, movement of the machine at a reduced machine speed based on the authorization data, wherein the reduced machine speed is less than 50% of a normal machine speed available to the machine when the operational mode is the normal mode.

In yet another aspect of the disclosure, a system for an excavator that includes a plurality of operational modes is disclosed. The operational modes include a normal mode, a hazard detected mode and an off mode. The hazard detected mode precludes movement of the excavator or operation of a hydraulic actuator disposed on the excavator. The system may comprise a controller configured to: receive authorization data when excavator is in the hazard detected mode; and, based on the authorization data, reduce power delivered to a hydraulic power system disposed on the excavator to enable movement of the excavator at a reduced machine speed or operation of the hydraulic actuator at a reduced actuator speed, wherein the reduced machine speed is less than 50% of a normal machine speed available to the excavator when the operational mode is the normal mode, and wherein the reduced actuator speed is less than 50% of a normal actuator speed available to the actuator when the operational mode is the normal mode. Wherein the controller may be configured to enable movement of the excavator or operation of the actuator for an enabling time period or until the operational mode changes from hazard detected mode to off mode and the excavator is subsequently restarted. The hazard detected mode is triggered in response to a detection of a hazard, the hazard including a person, an animal, a wall, a barrier, vegetation, an object or a machine.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts, unless otherwise specified.

Figure 1:
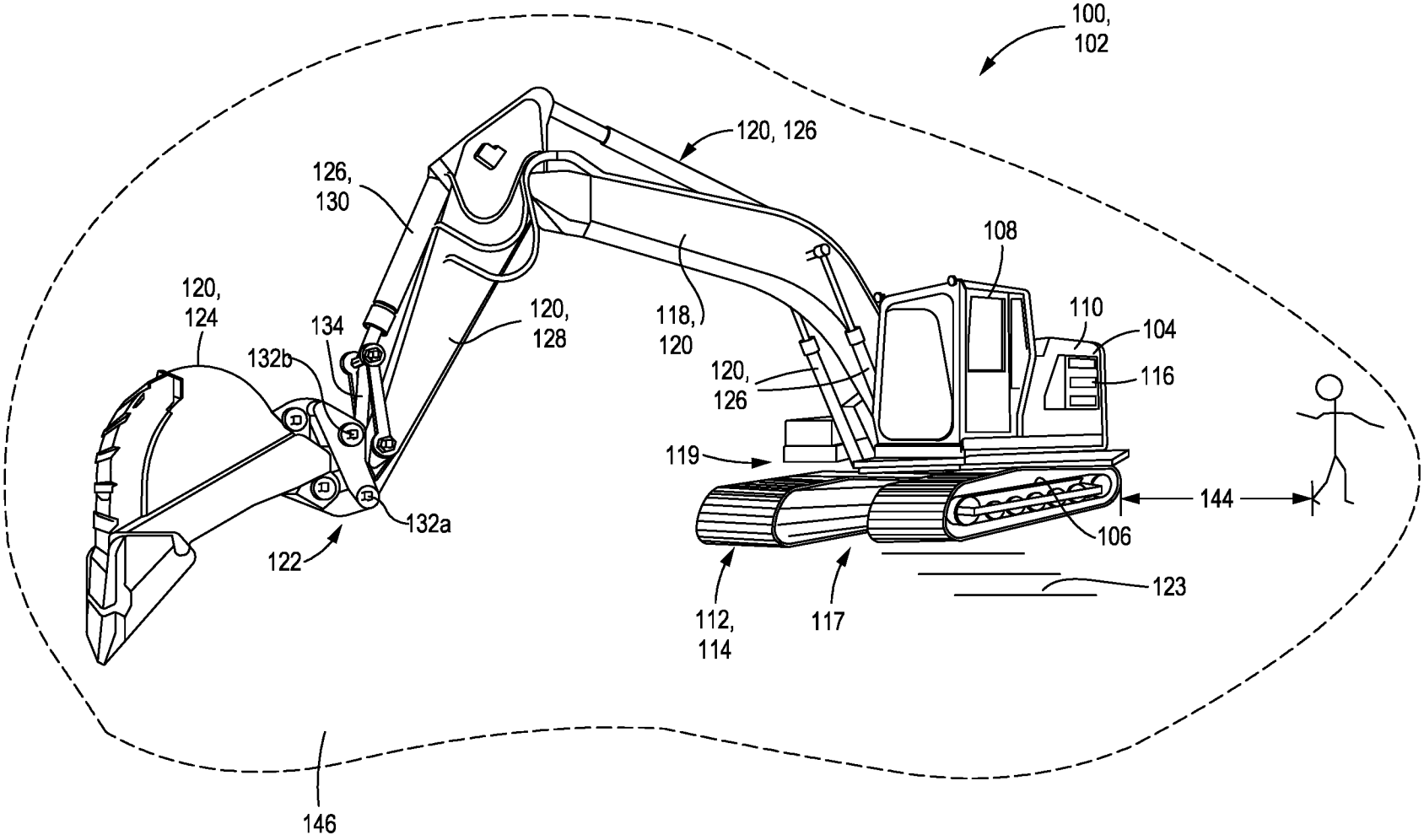
FIG. 1 is a perspective view of an exemplary machine that may include the maintenance-service system, according to the present disclosure.

FIG. 1 illustrates one example of a machine 100 that may incorporate the features of the present disclosure. The exemplary machine 100 may be a vehicle such as an excavator 102. While the following detailed description and drawings are made with reference to an excavator 102 as the exemplary machine 100, the teachings of this disclosure may be employed on other machines 100, including, but not limited to, a backhoe loaders, hydraulic mining shovels or the like.

The excavator 102 may include an upper carriage 104 rotationally connected to a lower carriage 106. The upper carriage 104 rotates in both the clockwise and the counterclockwise direction. The upper carriage 104 includes an operator station 108 and a body 110. The lower carriage 106 includes one or more ground engaging units 112. In the exemplary embodiment shown in FIG. 1, the ground engaging units 112 are track assemblies 114. One of ordinary skill in the art will appreciate that the machine 100 further includes a power source 116 (for example an engine), a propulsion system 117, and a hydraulic power system 119. The propulsion system 117 includes the ground engaging units 112 and is configured to drive the ground engaging units 112 to move the machine 100 on a surface 123. The hydraulic power system 119 may be powered by the power source 116 and is configured to provide power to the propulsion system 117, and/or actuators (e.g., boom actuator 120, stick actuator 130, etc.) and/or various attachments and components of the machine 100.

The excavator 102 further includes a boom 118 pivotably mounted on the body 110 and a hydraulic actuator assembly including boom actuators 120 which are operable by the user to manipulate the boom 118 by raising and lowering the boom 118 relative to the body 110. The excavator 102 further includes a stick 128 pivotally connected to the boom 118, and a stick actuator 130 connected to the stick 128. The stick actuator 130 is configured to pivot the stick 128 about the boom 118.

A pin grabber coupler 122 is disposed at an end of the stick 128 and is configured to receive a tool 124 such as a bucket, grapple, a hammer, a compactor or another attachment. In the embodiment shown in FIG. 1, the stick 128 is connected to the pin grabber coupler 122 by a first stick pin 132*a*. The stick actuator 130 is operably connected to the pin grabber coupler 122 by a power link 134 coupled to a second stick pin 132*b*. The stick actuator 130 is further configured to pivot the pin grabber coupler 122 about the first stick pin 132*a*.

The operator station 108 is configured to house control levers, joysticks, push buttons, and other types of control elements typically known in the art for actuating an operation of the excavator 102, the ground engaging units 112, the boom 118, stick 128 and the pin grabber coupler 122 and the tool 124. The machine 100 has a plurality of operational modes. The operational modes may include: off, normal, and/or hazard detected mode. When in the hazard detected mode, the machine 100 is (a) turned on and (b) movement of the machine 100 (e.g., rotational movement of the upper carriage 104/lower carriage 106, translational movement of the entire machine 100 over a surface 123, etc.) is disabled, and/or operation of one or more actuators 126 (e.g., hydraulic actuators such as the boom actuator 120 or the stick actuator 130, electric actuator, mechanical actuator or the like) disposed on the machine is disabled.

The machine 100 may further include a detection system 136. The detection system 136 may be disposed on the machine 100 or remote from the machine 100. The detection system 136 may include one or more sensors 138, one or more output members 140, and a detection system controller 142. The detection system controller 142 is in operable communication with the one or more sensors 138 and is configured to receive hazard data from such sensor(s) 138. The output member 140 may include, but is not limited to, a visual display, a log, a horn, flashing lights, buzzer or the like. The detection system controller 142 may include a detection system processor 152 and a detection system memory component 148.

The sensor(s) 138 may be disposed on the machine 100 or may be disposed remote from the machine 100. The hazard data is indicative of detection of another machine, a person, an animal, a wall, a barrier, vegetation, an object or the like (each a "hazard"), or detection of the hazard within a detection distance 144 from the machine 100, or detection of the hazard in a surveillance area 146 about the machine 100.

The detection system controller 142 may be configured to activate/trigger the hazard detected mode for the machine 100 in response to receipt of hazard data from one or more of the sensors 138. For example, the detection system controller 142 may be configured to change the operational mode of the machine 100 from normal mode to hazard detected mode based on the hazard data received, and to generate and transmit control commands to: (a) disable movement of the machine 100 (translational, rotational or the like); and/or (b) disable operation of one or more actuators 126 (e.g., hydraulic actuators such as the boom actuator 120 or the stick actuator 130, electric actuator, mechanical actuator or the like) disposed on the machine to prevent operation/movement of an associated component on the machine (e.g., stick 128, boom 118, tool 124 or the like).

In an embodiment, the detection system controller 142 may be configured to save the operational mode in a detection system memory component 148 or a data base, and/or transmit to a controller 154 of a maintenance-service system 150 the operational mode of the machine 100. The maintenance-service system 150 may be configured to be part of the detection system 136, a module of the detection system 136, or a separate system. The detection system controller 142 is in operable communication with the output member 140 and may be configured to activate the output member 140 to emit an audible alarm or display a visual warning via a display screen, flashing lights, etc. when the machine 100 is in hazard detected mode, or when an operator attempts to operate/move the machine 100 when the machine 100 is in hazard detected mode. The output member 140 is configured to emit an audible alarm, and/or display a visual warning via a display screen, flashing lights, etc. when activated by the detection system controller 142.

Figure 2:
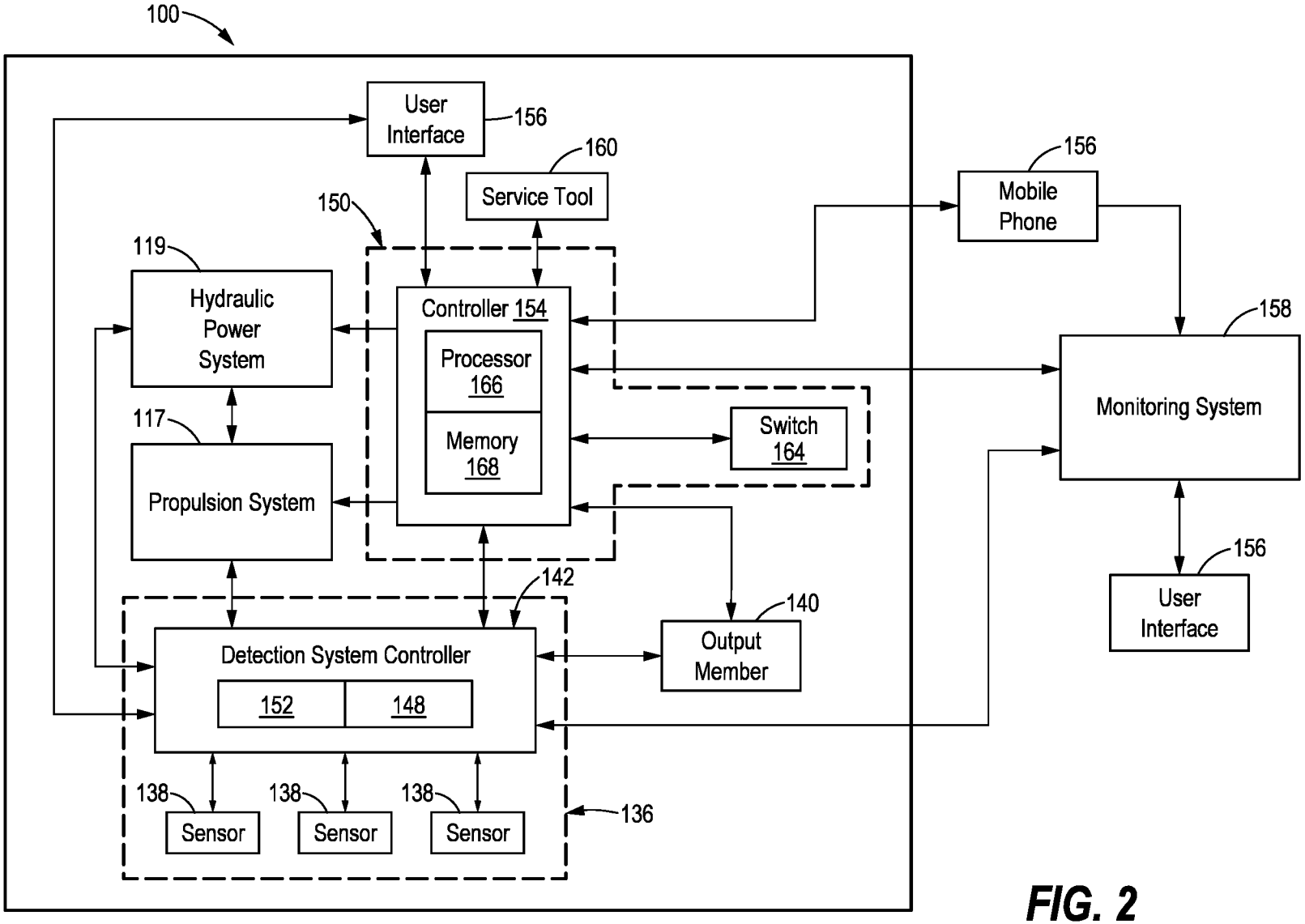
FIG. 2 is a block diagram of an embodiment of the maintenance-service system for use with the exemplary machine of FIG. 1.

FIG. 2 illustrates an exemplary maintenance-service system 150 in accordance with the present disclosure. The maintenance-service system 150 comprises controller 154. The maintenance-service system 150 may further comprise a switch, button, lever, key-card sensor, key-lock, or the like (collectively, "switch 164") disposed on the machine 100.

The controller 154 may be in operable communication with a user interface 156 that is configured to receive input from a user and/or output information to a user. The user interface 156 is configured to transmit authorization data to the controller 154 of the maintenance-service system 150, and may be disposed on the machine 100 (e.g., in the operator station 108) or may be disposed remote from the machine 100 (e.g. a mobile phone, a tablet, a computer, or the like). The authorization data may be information (e.g., a code or the like) entered by a user into the user interface 156, or the authorization data may be based on information entered by a user into the user interface 156. Alternatively, or in addition to, the user interface 156 may be inoperable communication with a remote monitoring system 158 (e.g., a fleet management system, or machine dealership system) and the authorization data may be requested by the user interface 156 from the monitoring system 158 and then transmitted to the controller 154 by the user interface 156 upon receipt of the authorization data by the user interface 156 (or the authorization data may be transmitted to the controller 154 by the monitoring system 158 itself).

The controller 154 may be in operable communication with a service tool 160. For example, sometimes maintenance or service personnel may connect a portable service tool 160 to the controller 154 while servicing, troubleshooting or calibrating a machine 100 that is in a factory, repair shop or service shop, at a dealership, or in the field. Such service tool 160 may be configured to output information to the user regarding the machine 100, components 162 of the machine 100 and/or one or more systems of the machine 100. The service tool 160 is also configured to transmit authorization data to the controller 154. The authorization data may be information (e.g., a code or the like) entered by a user into the service tool 160, or the authorization data may be based on information entered by a user into the service tool 160, or the authorization data may be programmed or stored in the service tool 160.

The controller 154 may be in operable communication with a monitoring system 158 disposed remote from the machine 100, for example a fleet management system configured to monitor the status of the machine 100. Such a monitoring system 158 may be configured to transmit authorization data to the controller 154. The authorization data may be generated automatically by the monitoring system 158 in response to input or a request from a user interface 156 that is in operable communication with the monitoring system 158 or alternatively the authorization data may be received by the monitoring system 158 from the user interface 156 (e.g., code entered into a computer, a fleet user interface or the like by a user that is supervising the monitoring of a machine 100 by the monitoring system 158) and then transmitted to the controller 154, or alternatively may be based on information received by the user interface 156 that is in operable communication with the monitoring system 158.

The controller 154 may be in operable communication with a switch 164 disposed on the machine 100. The switch 164 is configured to transmit authorization data (e.g., a code) to the controller 154 when the switch 164 is activated by a user.

The controller 154 may be in operable communication with the output member 140 disposed on the machine 100.

The controller 154 may include a processor 166 and a memory component 168. The controller 154 is in operable communication with the hydraulic power system 119 and/or the propulsion system 117. In the embodiment illustrated in FIG. 2, the controller 154 may be in operable communication with the detection system controller 142 of the detection system 136. In other embodiments, the controller 154 of the maintenance-service system 150 may be part of the detection system 136 or a module/part of the detection system controller 142.

The controller 154 may be configured to receive the currently active operational mode of the machine 100. In one embodiment, the operational mode may be received from the detection system controller 142 of the detection system 136 that is in operable communication with the controller 154 of the maintenance-service system 150. In another embodiment, the operational mode may be retrieved by the controller 154 from the detection system memory component 148 or from another database that the controller 154 is in operable communication with.

The controller 154 is configured to receive authorization data. Such authorization data may be received from: the user interface 156, the service tool 160, the monitoring system 158 or the switch 164.

When the machine 100 is in hazard detected mode and in response to receipt of valid authorization data, the controller 154 is configured to (a) reduce power delivered to the hydraulic power system 119 of the machine 100 and to (b) enable movement of the machine 100 at a reduced speed and/or enable operation of the one or more actuators 126 at a reduced speed. The reduction of power delivered to the hydraulic power system 119 has the effect of reducing the power output by the hydraulic power system 119 to the propulsion system 117, which reduces the translational speed of the machine 100, and the power output to the actuators 126, which reduces the speed of operation of the actuators 126.

In one embodiment, the reduced speed may be 1% to less than 50% of the speed available in normal mode to the machine 100 (normal machine speed) or actuator 126 (normal actuator speed). In another embodiment, the reduced speed may be 10-25% of the speed available in normal mode to the machine 100 (normal machine speed) or actuator 126 (normal actuator speed). In a refinement, the controller 154 may be further configured to enable operation of the machine 100 or actuator 126 for an enabling time period or until the machine 100 enters an off mode (is turned off) or is restarted.

The controller 154 may be further configured to also deactivate or suppress the display of a visual warning and/or emission of an audible alarm/alert by the output member 140 when the machine 100 is being moved or an actuator is being operated while the machine is in a hazard detected mode.

In some embodiments, the controller 154 may be configured to receive (in addition to the authorization data) a state selection of "maintenance" or "calibration." If the state selection of maintenance is received (in addition to the authorization data), the controller may be configured to: (a) reduce power delivered to the hydraulic power system 119 of the machine 100 and enable movement of the machine 100 at a reduced speed and/or enable operation of the one or more actuators 126 at a reduced speed; and deactivate or suppress the display of a visual warning and/or emission of an audible alarm/alert by the output member 140 when the machine 100 is being moved or an actuator is being operated while the machine is in a hazard detected mode. In some embodiments, the controller may transmit information associated with use of the "maintenance" state to the detection system 136 for logging in the detection system memory component 148.

Whereas if the state selection of calibration is received (in addition to the authorization data), the controller 154 may be configured to reduce power delivered to the hydraulic power system 119 of the machine 100 and enable movement of the machine 100 at a reduced speed and/or enable operation of the one or more actuators 126 at a reduced speed but not suppress (a) the display of a visual warning and/or (b) emission of an audible alarm/alert by the output member 140 when the machine 100 is being moved or an actuator is being operated while the machine 100 is in a hazard detected mode. Not suppressing or deactivating audible alarms or alerts or visual warnings may aid in calibration of the machine 100 or actuators 126.

The processor 166 may be a microcontroller, a digital signal processor (DSP), an electronic control module (ECM), an electronic control unit (ECU), a microprocessor or any other suitable processor 166 as known in the art. The processor 166 may execute instructions and generate control signals for reducing power delivered to the hydraulic power system 119, enabling movement of the machine 100 at a reduced speed and/or operation of the one or more actuators 126 at reduced speed, or suppression the output member 140 from displaying a visual warning and/or emitting an audible alarm. Such instructions may be read into or incorporated into a computer readable medium, such as the memory component 168 or provided external to the processor 166. In alternative embodiments, hard wired circuitry may be used in place of, or in combination with, software instructions to implement a control method.

The term "computer readable medium" as used herein refers to any non-transitory medium or combination of media that participates in providing instructions to the processor 166 for execution. Such a medium may comprise all computer readable media except for a transitory, propagating signal. Common forms of computer-readable media include, for example, a floppy disk, a flexible disk, hard disk, magnetic tape, or any other magnetic medium, a CD-ROM, any other optical medium, or any other computer readable medium.

The controller 154 is not limited to one processor 166 and memory component 168. The controller 154 may include several processors 166 and memory components 168. In an embodiment, the processors 166 may be parallel processors that have access to a shared memory component(s) 168. In another embodiment, the processors 166 may be part of a distributed computing system in which a processor 166 (and its associated memory component 168) may be located remotely from one or more other processor(s) 166 (and associated memory components 168) that are part of the distributed computing system. The controller 154 may also be configured to retrieve from the memory component 168 the operational mode of the machine 100 or other data necessary for the actions discussed herein.

Also disclosed is a method controlling a machine 100, the machine 100 having a plurality of operational modes, the plurality of operational modes including a normal mode, a hazard detected mode and an off mode. The method may comprise: after activation of the hazard detected mode, receiving, by a controller 154, authorization data; and enabling, by the controller 154, movement of the machine 100 at a reduced machine speed based on the authorization data, wherein the reduced machine speed is less than 50% of a normal machine speed available to the machine 100 when the operational mode is the normal mode.

INDUSTRIAL APPLICABILITY

In general, the foregoing disclosure finds utility in machines 100 having with detection systems 136 or the like that prevent movement of the machine 100 or actuators 126 on the machine 100 during service, calibration or troubleshooting when sensors 138 associated with the machine 100 detect another machine, a person, an animal, a wall, a barrier, vegetation, an object or the like in close proximity to the machine 100. The teachings of this disclosure enable an operator or technician to move the machine 100 to a desired location or troubleshoot or service the machine 100 and/or actuators 126.

Figure 3:
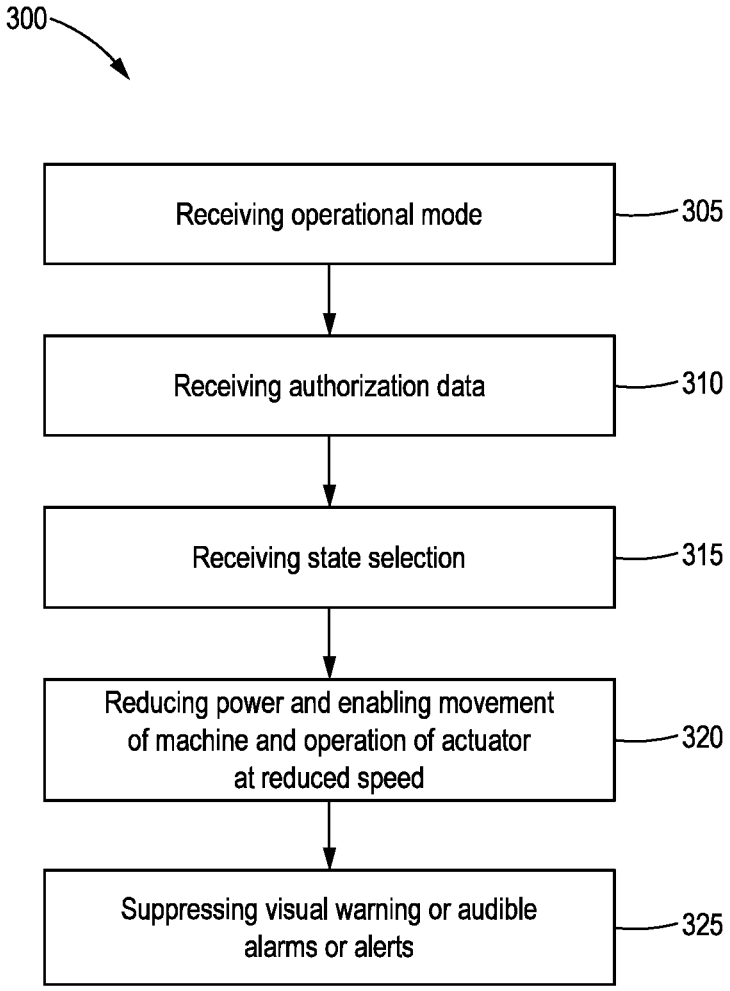
FIG. 3 is a flow diagram of one exemplary method, according to the present disclosure.

In operation, the controller 154 may be configured to operate according to a predetermined method 300, as shown for example in FIG. 3. FIG. 3 is an exemplary flowchart illustrating sample blocks which may be followed in a method 300 of controlling a machine 100 in a hazard detected mode.

In block 305, receiving, by the controller 154, the currently active operational mode of the machine 100.

In block 310, the method 300 includes, receiving, by the controller 154, authorization data. The authorization data may be received from a user interface 156, a service tool 160, a monitoring system 158 or a switch 164.

In block 315, the method 300, optionally includes receiving, by the controller, 154, state selection (maintenance or calibration) for the machine 100.

In block 320, the method 300 further includes, when the currently active operational mode is the hazard detected mode and the controller 154 receives valid authorization data for the machine 100, reducing, by the controller 154, power delivered to the hydraulic power system 119 of the machine 100 from the power source 116 and enabling, by the controller 154, movement of the machine 100 (at a reduced speed) and/or operation of one or more actuators 126 (at reduced speed) in response to and based on the authorization data received. In one embodiment, the reduced speed may be 1% to less than 50% of the speed available in the normal mode to the machine 100 and/or actuators 126. In another embodiment, the reduced speed may be 10-25% of the speed available in the normal mode to the machine 100 and/or actuators 126. In a refinement, the enabling may be for an enabling time period or until the machine 100 enters an off mode (is turned off) or is restarted.

In block 325, the method may optionally further include deactivating or suppressing the display of a visual warning and/or emission of an audible alarm/alert by the output member 140 when the machine 100 is being moved or an actuator is being operated while the machine is in a hazard detected mode. In some embodiments, the deactivating or suppressing may be done automatically by the controller 154 or may only occur if the user input a state selection of a maintenance state in block 315. In some embodiments block 325 may be omitted if in block 315 the user inputs a state selection of the calibration state.

It may be desirable to perform one or more of the blocks shown in FIG. 3 in an order different from that depicted.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A maintenance-service system for a machine that includes a plurality of operational modes, the plurality of operational modes including a normal mode, and a hazard detected mode, the maintenance-service system comprising:

a controller configured to:

receive authorization data when machine is in the hazard detected mode; and enable movement of the machine at a reduced machine speed based on the authorization data, wherein the reduced machine speed is less than 50% of a normal machine speed available to the machine when the operational mode is the normal mode, wherein, the hazard detected mode precludes movement of the machine.

2. The maintenance-service system of claim 1, wherein the authorization data is received from a user interface, a monitoring system, a service tool, or a switch disposed on the machine.

3. The maintenance-service system of claim 1, wherein the plurality of operational modes further include an off mode, wherein movement of the machine in the hazard detected mode is enabled by the controller for an enabling time period or until the operational mode changes from the hazard detected mode to the off mode.

4. The maintenance-service system of claim 1, wherein the hazard detected mode further precludes operation of an actuator disposed on the machine, wherein the controller is further configured to:

enable operation of the actuator at a reduced actuator speed based on the authorization data, wherein the reduced actuator speed is less than 50% of a normal actuator speed available to the actuator when the operational mode is the normal mode.

5. The maintenance-service system of claim 1, in which the machine further includes a hydraulic power system operably connected to a propulsion system, and the controller is further configured to reduce a power delivered to the hydraulic power system of the machine to enable movement of the machine in the hazard detected mode at the reduced machine speed.

6. The maintenance-service system of claim 1, in which the plurality of operational modes further includes an off mode; and in which the controller is further configured to allow movement of the machine at the normal machine speed when the operational mode changes from the hazard detected mode to the off mode and the machine is subsequently restarted.

7. The maintenance-service system of claim 1, wherein the hazard detected mode is triggered in response to a detection of a hazard, the hazard including a person, an animal, a wall, a barrier, a vegetation, an object or another machine.

8. The maintenance-service system of claim 1, in which the controller is further configured to suppress emission or display of an audible alarm, an alert or a visual warning by an output member associated with the machine while the machine is moved while in the hazard detected mode.

9. A method of controlling a machine, the machine having a plurality of operational modes, the plurality of operational modes including a normal mode, a hazard detected mode and an off mode, the method comprising:

activating the hazard detected mode and precluding movement of the machine;

after activation of the hazard detected mode, receiving, by a controller, authorization data; and enabling, by the controller, movement of the machine at a reduced machine speed based on the authorization data, wherein the reduced machine speed is less than 50% of a normal machine speed available to the machine when the operational mode is the normal mode.

10. The method of claim 9, wherein the authorization data is received from a user interface, a monitoring system, a service tool or a switch.

11. The method of claim 9, wherein the enabling occurs for an enabling time period.

12. The method of claim 9, wherein the hazard detected mode further precludes operation of an actuator disposed on the machine, the method further comprising:

enabling, by the controller, operation of the actuator at a reduced actuator speed based on the authorization data, wherein the reduced actuator speed is less than 50% of a normal actuator speed available to the actuator when the operational mode is the normal mode.

13. The method of claim 12 further including reducing power delivered to a hydraulic power system disposed on the machine to enable movement of the machine at the reduced machine speed or to enable operation of the actuator at the reduced actuator speed.

14. The method of claim 12, wherein the hazard detected mode is triggered in response to a detection of a hazard, the hazard including a person, an animal, a wall, a barrier, a vegetation, an object or another machine.

15. The method of claim 9 further comprising suppressing or deactivating emission or display of an audible alarm, an alert or a visual warning by an output member associated with the machine while the machine is moved while in the hazard detected mode.

16. The method of claim 9, wherein the reduced machine speed is 10-25% of the normal machine speed available to the machine when the operational mode is the normal mode.

17. A system for an excavator that includes a plurality of operational modes, the operational modes including a normal mode, a hazard detected mode and an off mode, the hazard detected mode precluding movement of the excavator or operation of a hydraulic actuator disposed on the excavator, the system comprising:

a controller configured to:

receive authorization data when excavator is in the hazard detected mode; and based on the authorization data, reduce power delivered to a hydraulic power system disposed on the excavator to enable movement of the excavator at a reduced machine speed or operation of the hydraulic actuator at a reduced actuator speed, wherein the reduced machine speed is less than 50% of a normal machine speed available to the excavator when the operational mode is the normal mode, and wherein the reduced actuator speed is less than 50% of a normal actuator speed available to the actuator when the operational mode is the normal mode, wherein the controller is configured to enable movement of the excavator or operation of the actuator for an enabling time period or until the operational mode changes from hazard detected mode to off mode and the excavator is subsequently restarted, wherein the hazard detected mode is triggered in response to a detection of a hazard, the hazard including a person, an animal, a wall, a barrier, vegetation, an object or a machine.

18. The system of claim 17, wherein the authorization data is received from a user interface, a monitoring system, a service tool or a switch.

19. The system of claim 17, wherein the reduced machine speed is 10-25% of the normal machine speed available to the excavator when the operational mode is the normal mode, wherein the reduced actuator speed is 10-25% of the normal actuator speed available to the actuator when the operational mode is the normal mode.

20. The system of claim 17, in which the controller is further configured to suppress emission or display of an audible alarm, an alert or a visual warning by an output member associated with the machine while the machine is moved while in the hazard detected mode.

* * * * *